United States Patent [19]

Seward, III

[11] 4,454,791

[45] Jun. 19, 1984

[54] LOCKABLE ADJUSTABLE WRENCH

[76] Inventor: William E. Seward, III, P.O. Box 266, Claremont, Va. 23899

[21] Appl. No.: 377,065

[22] Filed: May 11, 1982

[51] Int. Cl.[3] ..... B25B 13/14

[52] U.S. Cl. ..... 81/133; 81/130 R; 81/142

[58] Field of Search ..... 81/128–130, 81/132–133, 142, 145–149, 151, 155, 160, 162–163, 170–172

[56] References Cited

U.S. PATENT DOCUMENTS

| | | | |
|---|---|---|---|
| 207,709 | 9/1878 | Brett | 81/130 A X |
| 598,588 | 2/1898 | Whitehead | 81/133 |
| 777,025 | 12/1904 | Jacobsen | 81/145 |
| 1,438,641 | 12/1922 | Gazlay | 81/133 |
| 1,456,208 | 5/1923 | Armstrong | 81/133 |
| 1,458,037 | 6/1923 | Dickey | 81/151 |
| 3,948,120 | 4/1976 | Hancock | 81/170 X |

*Primary Examiner*—Frederick R. Schmidt
*Assistant Examiner*—Debra S. Meislin
*Attorney, Agent, or Firm*—Harvey B. Jacobson

[57] ABSTRACT

A lock for an adjustable jaw wrench of the type including a sliding jaw having a rack gear integral therewith and a rotatable gear or finger wheel in meshing engagement therewith so that by rotation of the rotatable gear, the slidable jaw may be moved toward and away from a stationary jaw for adjusting the effective size of the wrench. The lock of the present invention includes a movable component which lockingly engages both the rack gear and the rotatable gear or finger wheel thus locking these two components stationarily in relation to the body of the wrench and also locking them in stationary relation to each other. The movable lock includes a laterally slidable component disposed in a transverse opening in the body of the wrench with peripheral edge surface portions of the movable component including teeth engageable with the teeth on the rack gear and the teeth on the rotatable gear to maintain the gears locked in relation to each other and in relation to the body of the wrench with the movable lock component having the end portions thereof flush with the body of the wrench when in locked position and having one end projecting slightly outwardly of the body of the wrench when in unlocked position to facilitate lateral sliding movement thereof between a locked and unlocked position.

2 Claims, 4 Drawing Figures

LOCKABLE ADJUSTABLE WRENCH

BACKGROUND OF THE INVENTION

1. Field of the Invention

The present invention generally relates to an adjustable jaw wrench of the type including a sliding jaw having a rack gear rigid with respect thereto for moving the jaw in response to rotational movement of a rotatable gear or finger wheel in meshing engagement therewith with the wrench including a movable lock component which can be manually manipulated for simultaneously lockingly engaging the teeth on the rack gear and the teeth on the rotatable gear thereby locking these two components rigidly with respect to the body of the wrench and rigidly with respect to each other thereby securely locking the wrench in adjusted position to enable repetitive use thereof on a nut, bolt or the like with the component being laterally movable in a transversely extending recess or opening in the body of the wrench.

2. Description of the Prior Art

Adjustable jaw wrenches of various types have been known and used for many years with such wrenches including a rack gear unitary with or integrally connected with the movable or sliding jaw of the wrench with the rack gear meshing with a rotatable gear, finger wheel or the like to move the sliding jaw in relation to the stationary jaw when the rotatable gear or finger wheel is rotated. One of the problems which exists with this type of wrench is the tendency of the wrench to change its setting during use which may be due to the hand of the person using the wrench coming into contact with and rotating the rotatable gear or pressure exerted on the jaws of the wrench causing rotation of the rotatable gear to some extent thus enabling the size of the wrench to be effectively enlarged. Such maladjustment of this type of wrench results in the wrench not properly fitting the bolt or nut causing it to sometimes slip off of the nut or bolt thereby resulting in injury to the hand, particularly the knuckles, of the user, and also rounding off the corners of the nut or bolt. Some attempts have been made to provide lock devices for locking the adjustable wrench in adjusted position. The following U.S. patents are exemplary of the development of the art in this field of endeavor.

U.S. Pat. No. 765,059
U.S. Pat. No. 984,280
U.S. Pat. No. 1,056,275
U.S. Pat. No. 1,265,925
U.S. Pat. No. 1,648,519.

While the above patents include locking structures, they generally are somewhat difficult to manipulate and serve to lock only a single component of the movable components of the wrench.

SUMMARY OF THE INVENTION

An object of the present invention is to provide an adjustable jaw wrench including a lock mechanism in the form of a movable component which lockingly engages both the movable jaw of the wrench and the mechanism for moving the movable jaw.

Another object of the invention is to provide a lock for a movable jaw wrench in which the movable component is oriented in a transversely extending opening or recess in the body of the wrench so that the locking component can be moved laterally in relation to the body of the wrench between a locked and unlocked position by exerting inward pressure on one of the end portions of the locking component to cause it to slide laterally in relation to the body of the wrench.

A further object of the invention is to provide a lock for an adjustable jaw wrench in accordance with the preceding objects in which the wrench includes a rack gear on the adjustable jaw and a rotatable gear in meshing engagement therewith in order to move the adjustable jaw to a desired position by rotating the rotatable gear with the lock member including teeth thereon engaging both the teeth on the rack gear and the teeth on the rotatable gear for locking the rack gear and rotatable gear to the body of the wrench and locking them in relation to each other.

Still another object of the invention is to provide a lock for an adjustable jaw wrench in accordance with the preceding objects which is relatively inexpensive to incorporate into a wrench, easy to manipulate, long lasting and dependable in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
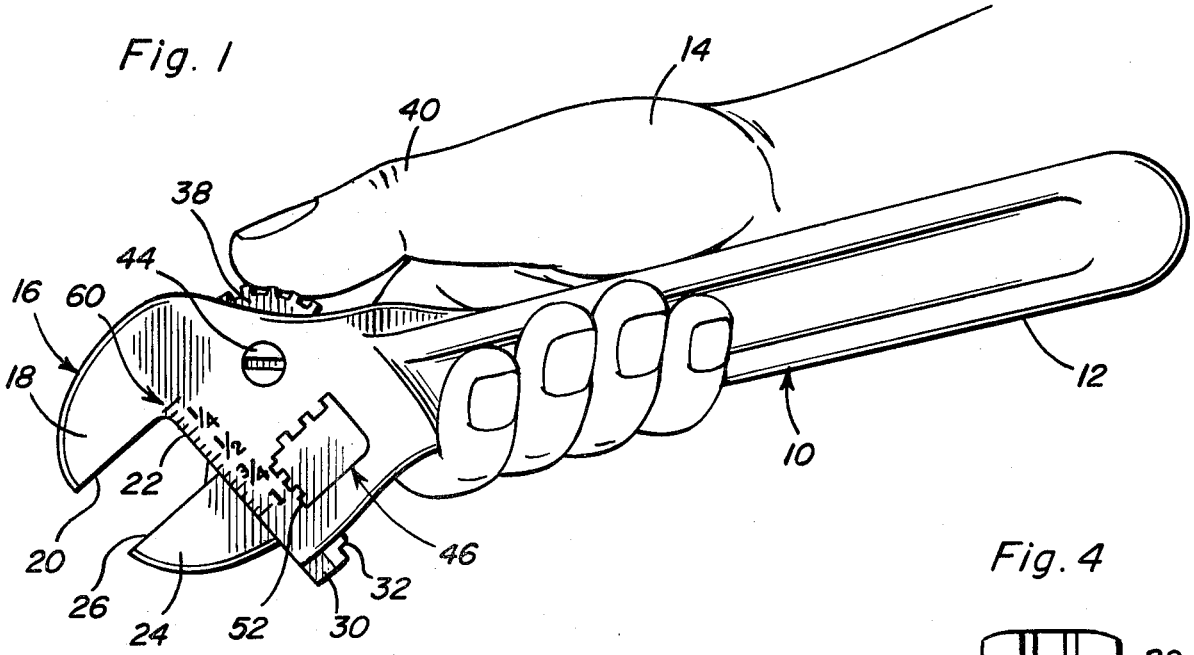
FIG. 1 is a perspective view of an adjustable jaw wrench with the lock of the present invention incorporated therein.
Figure 2:
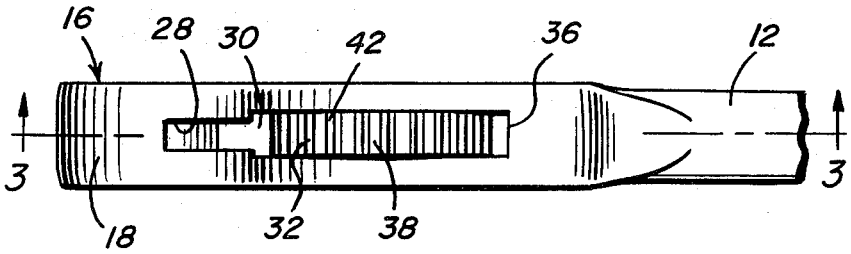
FIG. 2 is an enlarged plan view of the end of the wrench having the stationary and adjustable jaw assembly thereon.

Referring now specifically to the drawings, the adjustable end wrench having the lock of the present invention incorporated therein is generally designated by numeral 10 and includes an enlongated handle 12 of any conventional shape and configuration and the length thereof may be commensurate with the size of the wrench so that the handle 12 can be easily grasped and manipulated by the hand 14 of a user. At one end of the handle 12, the wrench includes a body or head generally designated by numeral 16 which includes a stationary jaw 18 integral therewith or of unitary construction therewith in which the stationary jaw 18 includes a jaw face 20 that is in acute angular relation to the longitudinal axis of handle 12 as is conventional practice in constructing an adjustable open end wrench. The angle of the jaw face 20 can vary from a parallel relation to the longitudinal axis of the handle 12 to any other desired acute angle. The body 16 merges with and is integral with the handle 12 and has a thickness generally equal to the width of the handle 12 although it may be somewhat thicker if desired. The vertical and horizontal dimensions of the body or head 16 of the wrench may vary depending upon the size characteristics of the wrench and includes an inner end edge 22 to engage one of the flats on a bolt head or nut when the jaw face 20 is engaged with another flat on the bolt head or nut in perpendicular relation to the inner edge 22. Thus, the inner end edge 22, in effect, limits the insertion of the wrench onto the bolt or nut in a conventional manner.

The wrench 10 also includes a movable jaw 24 having a jaw face 26 thereon in parallel relation to the jaw face 20 to engage a flat surface on a bolt head or nut in opposed relation to the jaw face 20 in a conventional manner so that rotation of the bolt or nut can be accomplished by exerting torque on the handle 12 of the wrench 10. The interior of the body 16 includes a through passageway 28 communicating with the inner edge 22 thereof thus defining a slot communicating with the inner edge 22 or throat of the wrench for slidably receiving the elongated and projecting rack gear 30 on the movable jaw 24 with the rack gear 30 including a plurality of longitudinally spaced teeth 32 along the edge thereof remote from the movable jaw face 26. The aforementioned structure is conventional adjustable open-end wrench structure such as that found in many commercially available adjustable jaw wrenches. The rack gear 30 guides and retains the slidable jaw 24 in proper orientation with respect to the stationary jaw 18.

Figure 4:
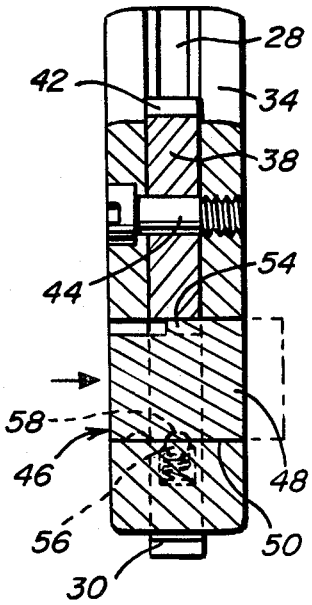
FIG. 4 is a transverse sectional view taken substantially upon a plane passing along section line 4—4 of FIG. 3 illustrating further structural details of the components of the invention including the manner in which the lock member slides laterally in relation to the wrench.
Figure 3:
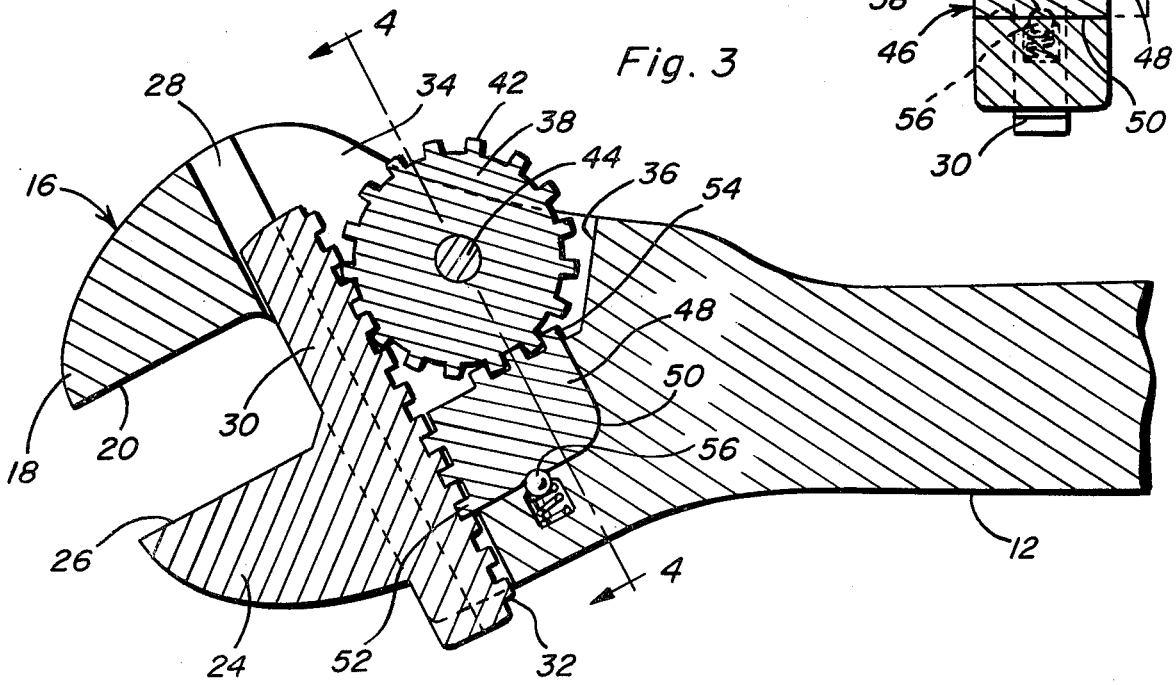
FIG. 3 is a longitudinal sectional view, on an enlarged scale, taken generally along section line 3—3 of FIG. 2 illustrating the structural relationships of the components of the invention.

The passageway 28 is provided with an enlarged area 34 at its upper edge terminating in a rear wall 36 as illustrated in FIG. 3 for receiving a rotatable gear 38 therein. The recess defined by the enlarged portion of the passageway 28 as designated by the reference numeral 34 and the rear wall 36 is sufficiently large to receive the rotatable gear with a portion of the periphery thereof projecting above the upper edge of the wrench body 16 as illustrated in FIGS. 1 and 3 so that the thumb 40 on the user's hand 14 can be used to rotate the rotatable gear 38. The rotatable gear 38 includes teeth 42 on the periphery thereof in meshing engagement with the teeth 32 on the rack gear 30 as illustrated in FIG. 3 so that upon rotation of the gear 38, the movable jaw 24 will be moved toward and away from the stationary jar 18. A transversely extending shaft 44 rotatably supports the gear 38 in position and may be in the form of a screw threaded member countersunk into one side of the body 16 and threaded into the other as illustrated in FIG. 4 thereby rotatably but removably supporting the rotatable gear 38 in the body 16 so that it can be removed when desired and when the gear 38 is removed, the rack gear 30 and the movable jaw can also be removed for cleaning, repair, replacement and the like.

A lock assembly generally designated by numeral 46 is associated with the body 16 and includes a lock member 48 in the form of a block or body which is laterally slidably mounted in a transverse opening or recess 50 in the body 16 which is in communication with the passageway 28 and the recess defined by area 34 and wall 36 as illustrated in FIG. 3. The lock member 48 has a length substantially equal to the thickness of the body 16 and is of generally square or rectangular configuration although this may vary. The lock member 48 is provided with two sets of lock teeth 52 and 54 on the periphery thereof which are capable of sliding meshing engagement with the teeth 32 on the rack gear and the teeth 42 on the rotatable gear 38 as illustrated in FIG. 3 when in the locked position. As illustrated in FIG. 4, the lock teeth 52 and 54 only extend partially along the longitudinal length of the lock member 48 so that when the lock member 48 is in the locked position as illustrated in FIG. 4, the lock teeth 52 and 54 are in meshing engagement with the teeth 32 and teeth 42 but when the lock member is moved to an unlocked position as shown in broken line in FIG. 4, the lock teeth 52 and 54 will not be engaged with the rack teeth 32 and the rotatable gear teeth 42 thereby enabling the rotatable gear 38 to be rotated to adjust the sliding jaw 24. The lower surface of the opening 50 is provided with a spring loaded ball detent assembly 56 associated with spaced recesses or sockets 58 in the lower surface of the lock member 48 to frictionally and releasably lock the lock member in either its locked position or its unlocked position. Thus, by exerting lateral pressure from either end of the lock member 48, the lock member can be moved from a locked position to an unlocked position. When the lock member is in the locked position, the teeth 52 and 54 thereon simultaneously engage and simultaneously lock both the rack gear 30 and rotatable gear 38 to prevent them from movement in relation to the body 16 and also this locking engagement prevents relative movement between the rotatable gear and rack gear.

As illustrated in FIG. 1, a graduated scale and indicia generally designated by numeral 60 is provided on the surface of the body 16 so that when the jaw face 26 is aligned therewith, there will be an indication as to the size of the wrench or a separate index line may be provided on the movable jaw 24 if desired. In any event, the graduations on the graduated scale 60 may correspond with the spacing of the teeth 32 and 42 so that movement of the rotatable gear 38 a distance equal to one tooth will move the sliding gear one increment of the graduated scale. For example, if the graduated scale 60 is divided into 1/16-inch increments, the teeth 32 and teeth 42 will be constructed so that for each tooth 42 passing into the recess 34, there will be corresponding 1/16-inch movement of the sliding jaw 24 thereby enabling the adjustable jaw wrench to be preset prior to engaging it with a bolt head or nut thereby eliminating the necessity of actually placing the wrench on the bolt head or nut and tightening the sliding jaw into position. This capability of being able to preadjust the wrench to the standard size of the bolt head or nut effectively enhances the utilization of the wrench and the lock assembly, when moved into the locking position will maintain the adjustment of the wrench during repetitive use thereof thereby rendering the wrench more efficient in use with less chance of injury to the user and damage to the nuts or bolt heads with which the wrench is used.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A lock assembly for an adjustable jaw wrench of the type including a stationary jaw having transversely opposed, generally parallel flat surfaces, a movable adjustable jaw, a rack gear having spur teeth on the adjustable jaw, a rotatable gear having spur teeth on the periphery thereof meshing with the rack gear, means supporting the rotatable gear from the stationary jaw for rotation about a transverse axis perpendicular to the flat surfaces, said rotatable gear being manually rotatable for moving the adjustable jaw in relation to the stationary jaw, said wrench including an elongated handle rigid with the stationary jaw, said movable adjustable jaw being slidably supported on the wrench, said rotatable gear having a portion of the peripheral spur teeth projecting from a peripheral surface of the wrench extending between the flat surfaces to enable access thereto for rotation by exerting tangential force thereon by using the thumb of the hand grasping the wrench by the handle to enable one-hand adjustment of the wrench, said lock assembly comprising a lock member, means movably mounting the lock member on the wrench said lock member including means thereon engaging the rack gear and separate means thereon engaging the rotatable gear thereby simultaneously locking the rack gear and rotatable gear to the wrench and preventing relative movement of the rack gear and rotatable gear in relation to each other, said means movably mounting the lock member including a transverse opening in the wrench, said lock member being laterally slidably and non-rotatably received in said opening and having a length generally equal to the thickness of the wrench, said lock member having ends generally flush with the flat surfaces of the stationary jaw of the wrench when in its locked position and one end projecting therefrom when in unlocked position, said means on the lock member engaging the rack gear including spur teeth on the lock member slidably meshing with the spur teeth on the rack gear, said separate means meshing with the spur teeth on the rotatable gear including separae spur teeth on the lock member slidably meshing with the rotatable gear spur teeth, the spur teeth on the lock member being completely disengaged from the teeth on the rotatable gear and rack gear when in unlocked position.

2. The structure as defined in claim 1 together with spring detent means on the wrench engageable with the lock member to secure it releasably in its locked and unlocked position, a graduated scale means on the wrench associated with the movable adjustable jaw to indicate the distance between the jaws to enable the distance between the jaws to be set in a predetermined spaced relation, said scale means and gear teeth being calibrated to indicate movement of the movable jaw a predetermined increment.

* * * * *